United States Patent [19]

Crapser et al.

[11] Patent Number: 4,690,312

[45] Date of Patent: Sep. 1, 1987

[54] DUAL FUNCTION CAP

[75] Inventors: James R. Crapser; Scott W. Demarest, both of Racine County, Wis.

[73] Assignee: S. C. Johnson & Son, Inc., Racine, Wis.

[21] Appl. No.: 863,659

[22] Filed: May 15, 1986

[51] Int. Cl.[4] ..... B65D 83/00

[52] U.S. Cl. ..... 222/402.17; 222/481; 222/531; 239/394

[58] Field of Search ..... 222/394, 402.13, 402.17, 222/402.1, 153, 482, 402.11, 566, 557, 478, 481, 531, 533; 239/394, 446

[56] References Cited

U.S. PATENT DOCUMENTS

| | | | |
|---|---|---|---|
| 150,376 | 4/1874 | Tomlinson | 239/446 |
| 1,702,523 | 2/1929 | Schafer | 239/377 |
| 1,747,670 | 2/1930 | Hull | 239/446 |
| 2,823,076 | 2/1958 | Nurkiewicz | 239/393 |
| 2,887,273 | 5/1959 | Anderson et al. | 239/446 |
| 3,112,885 | 12/1963 | Bell et al. | 239/394 |
| 3,533,554 | 10/1970 | Mongerson | 239/27 |
| 3,567,081 | 3/1971 | Meshberg | 222/402.17 |
| 3,637,142 | 1/1972 | Gassaway | 239/394 |
| 3,830,432 | 8/1974 | Grohe | 239/394 |
| 3,843,030 | 10/1974 | Miscallef | 222/554 |
| 3,940,024 | 2/1976 | Russo et al. | 222/182 |
| 4,196,857 | 4/1980 | Bauer | 239/327 |
| 4,247,048 | 1/1981 | Hayes | 239/396 |
| 4,534,512 | 8/1985 | Chow et al. | 239/394 |

*Primary Examiner*—Joseph J. Rolla
*Assistant Examiner*—Kenneth Noland

[57] ABSTRACT

An overcap assembly for a container having a pressure valve or the like, for dispensing a product selectively as a spray or a fog. The assembly has an overcap and a nozzle device which can be attached to the overcap outlet and is rotatable or otherwise movable between two positions relative to the overcap. In one position, a first outlet of the nozzle device communicates with the pressure valve of the container, while a second outlet of the nozzle device does so in the second relative position. One outlet is suitable for producing a spray, while the other is for producing a fog. Preferably, locking members are provided to lock the overcap actuator in a position to hold the container valve open when the nozzle device is in one (but not the other) of the two positions, to ensure complete use of the product in the container. It should also be noted that because of the construction of flange 96 and lip 46, the mere moving of the nozzle device 16 to the fog position does not actuate the container until button 20 is depressed. This prevents accidental actuation which is a problem with other total release systems. Also in the event of accidental actuation, rotation of nozzle device 16 to the spray position will disengage the locking mechanism and stop the dispensing of the contents of the container 14.

4 Claims, 17 Drawing Figures

Fig. 2A.
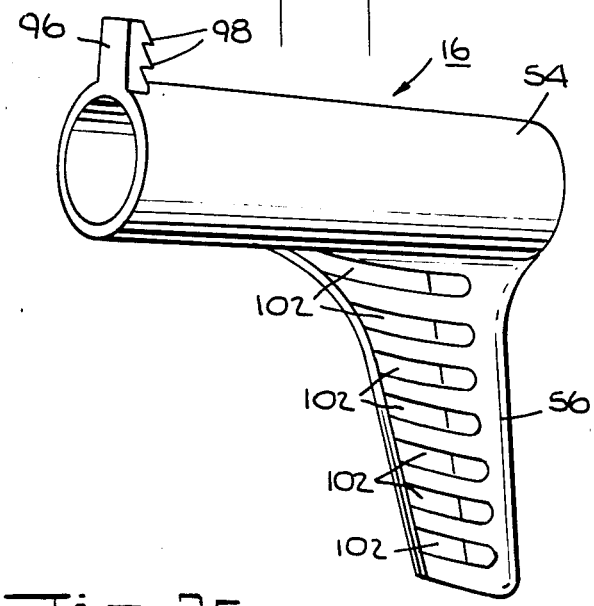
Fig. 2B.
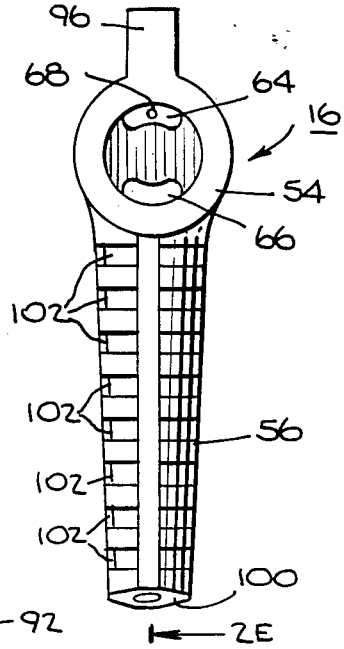
Fig. 2G.
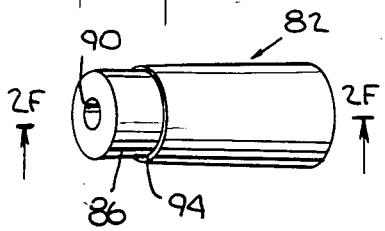
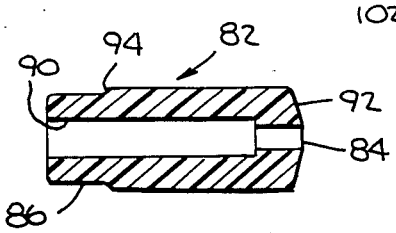
Fig. 2F.
Fig. 2C.
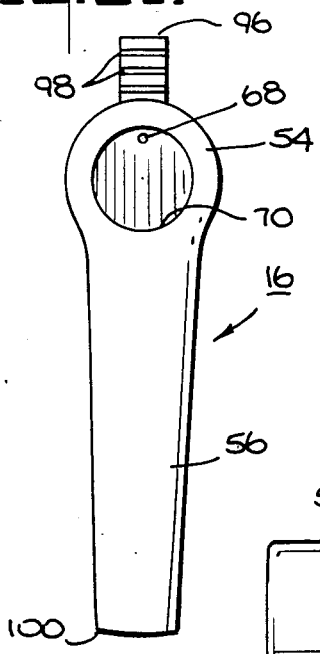
Fig. 2E.
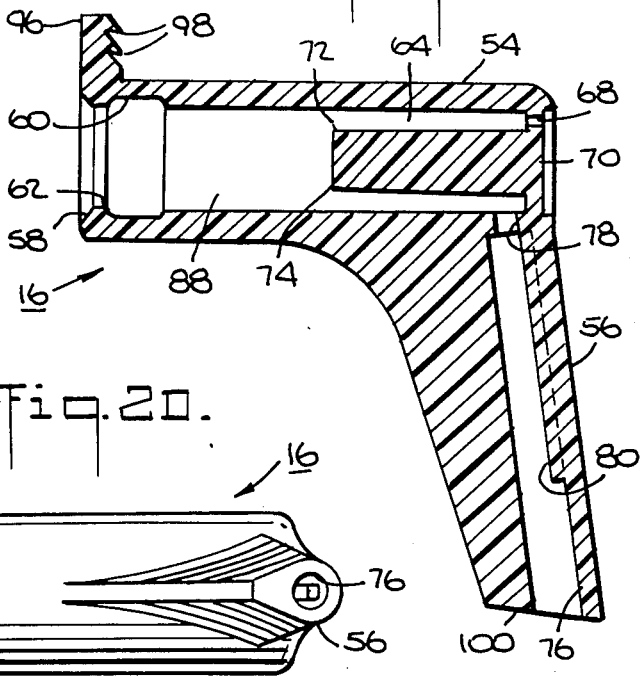
Fig. 2D.
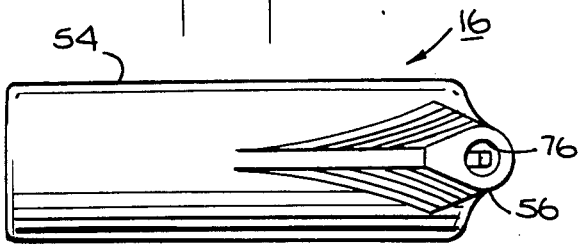

DUAL FUNCTION CAP

BACKGROUND OF THE INVENTION

The present application pertains in general to dispensers for dispensing liquid products from a container, and more particularly to an overcap assembly for such a container, designed to permit a user to produce either a short spray or a fog of the entire contents of the container.

Devices manufactured for use with a can or other container and used to dispense a product provided therein are well known. One type of dispenser cap of this general sort permits the dispensing of the product in the container at the press of a valve button which constitutes part of the cap. Typically, depression of such a valve button releases the product in the form of a spray. Other types of caps which dispense product as a fog or the like are also known, as are caps which can dispense the product in the form of a stream.

It has been proposed at various times to produce container caps to permit dispensing a product from a container with one of two patterns. For example, two different spray patterns might be possible, depending on the position of a particular part of the cap. However, applicants know of no device which would make it possible to dispense the product either as a spray in different axes, depending on the position of a single movable part of the cap. Moreover, most devices which permit selection of two or more directions of output are relatively complex and awkward. (Hereinafter, throughout the specification and claims, "spray" is used to mean material in droplet form, moving with relatively great directivity, while "fog" is used to mean material in particulate form, moving with relatively low force and directivity in a cloud like body such as produced when the entire contents of an aerosol container are expelled at one time.)

It would be desirable to provide a simple, reliable and easy-to-manufacture device suitable for use on a dispenser can or other container and able to dispense the contents selectively either as a spray or as a fog.

SUMMARY OF THE INVENTION

Accordingly, it is an object of the invention to provide an overcap assembly for a container, capable of dispensing a liquid in the can either as a spray or as a fog.

Another object of the invention is to provide such an overcap assembly which is easy to use, reliable, and economical to manufacture.

Another object of the invention is to provide an overcap assembly that can disperse product at a substantially horizontal angle in spray mode and a substantially vertical angle in fog mode.

Another object of the invention is to provide such an overcap assembly with which the type of dispensing can be selected by the movement of a single element.

If the product is an insecticide, for example, it may be desirable to dispense the material as a spray to provide a concentrated dose for heavily infected areas, and then to switch to fog dispensing to more uniformly expose an enclosed area to the product.

Still another object of the invention is to incorporate such an overcap assembly with a feature which provides the option of locking the dispenser valve open when in one of the two positions, e.g., the fog position, to ensure complete release of product during use.

According to the present invention, these objects are achieved by providing an overcap assembly having, among other features, an actuator to open a valve to release product from a container into an outlet passage, and a nozzle device, for example an outsert, which fits onto the outlet, and which itself contains two product passages. One passage leads to an orifice which is adapted to dispense product as a spray, while the other leads to an orifice adapted to produce a fog. The nozzle device is rotatable or otherwise movable between two positions, in each of which one of the two passages of the nozzle device is blocked while the other communicates with the outlet of the overcap. Actuation of the valve with the nozzle device in place causes the product in the container to be output as a spray or as a fog, depending on the position of the nozzle device relative to the overcap. The nozzle device preferably can be removed from the overcap outlet, which may thus be designed to provide a third form of output, if that is desired.

Other objects, features and advantages of the present invention will be more fully understood from a consideration of the following detailed description of the preferred embodiment, taken in conjunction with the accompanying drawings.

BRIEF DESCRIPTION OF THE FIGURES

In the figures, like elements are indicated by like reference characters.

FIG. 1A shows the overcap assembly with the nozzle device in the spray position, while FIG. 1B shows the nozzle device in the fog position.

FIGS. 2A–G show various views of the nozzle device. FIG. 2A is a perspective view, FIG. 2B is a back view, FIG. 2C is a front view, FIG. 2.D is a bottom view, FIG. 2E is a cross section taken from line 2E—2E of FIG. 2B, FIG. 2F is a perspective view of an orifice reducer used with the nozzle device to produce a fog, and FIG. 2G is a cross sectional view taken from line 2G—2G in FIG. 2F, of the orifice reducer.

FIG. 3A is a perspective view, partly exploded, showing the relation of the overcap to the top of a can with a pressure valve, FIG. 3B is a front view of the overcap, FIG. 3C is a top view, and FIG. 3D is a sectional view taken from line 3D—3D of FIG. 3B.

DETAILED DESCRIPTION OF THE PREFERRED EMBODIMENT

Figure 1B:
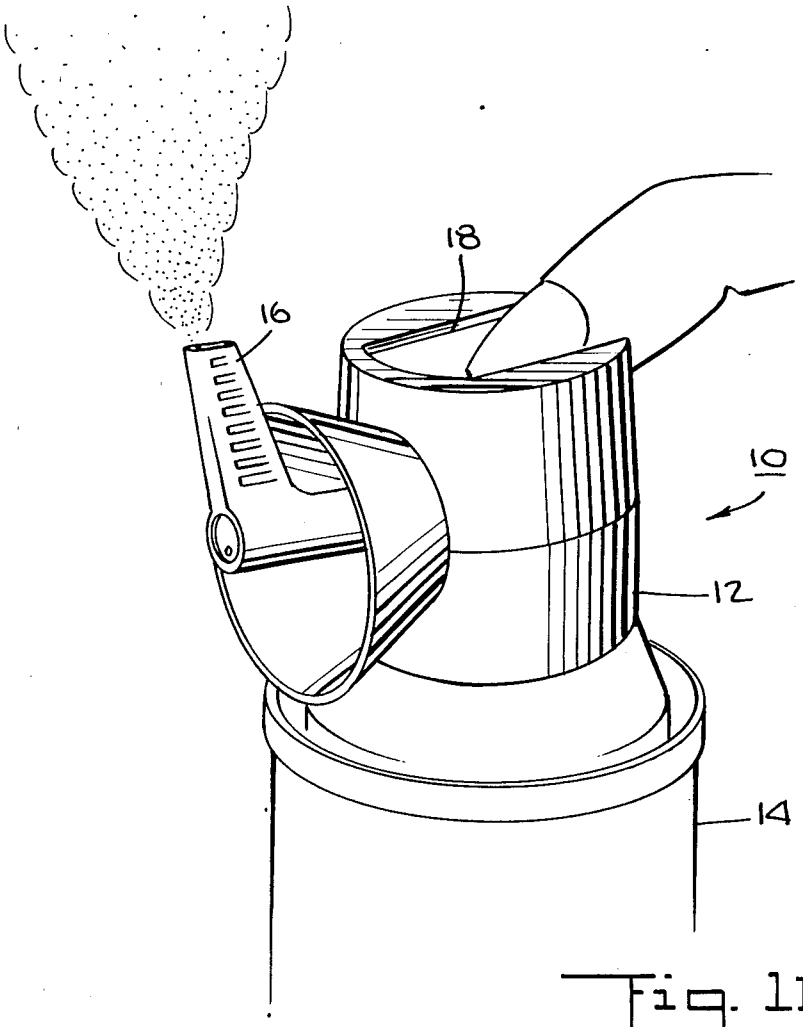
FIGS. 1A and 1B are perspective views of a can having an overcap assembly according to the preferred embodiment of the invention.
Figure 1A:
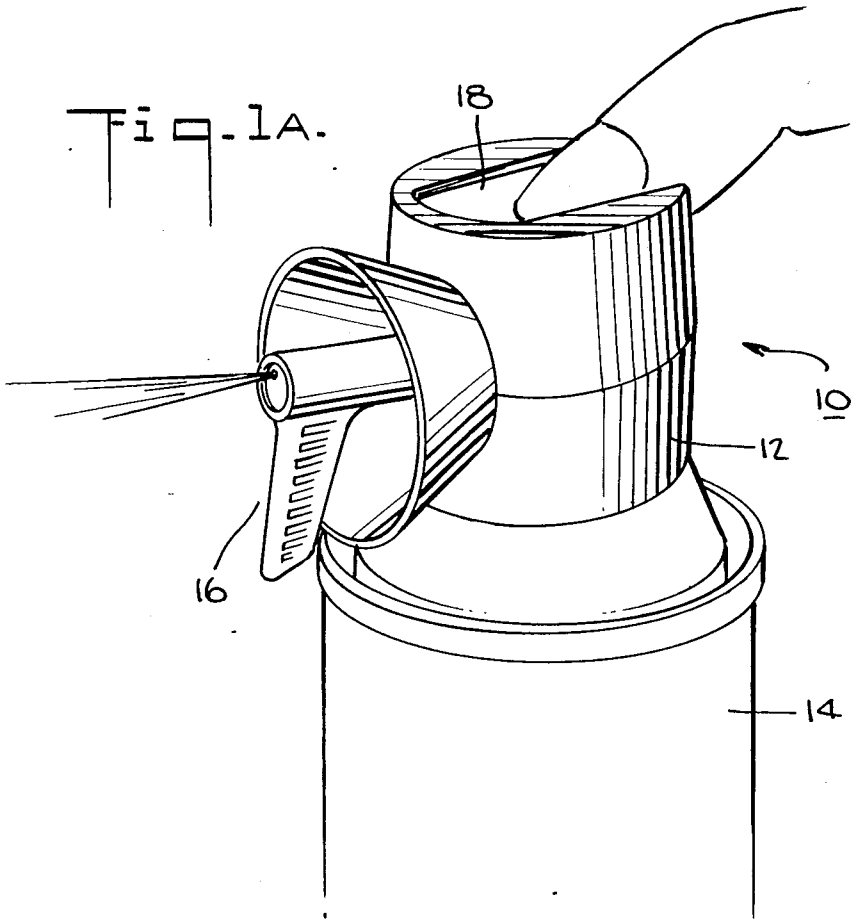
Figure 3A:
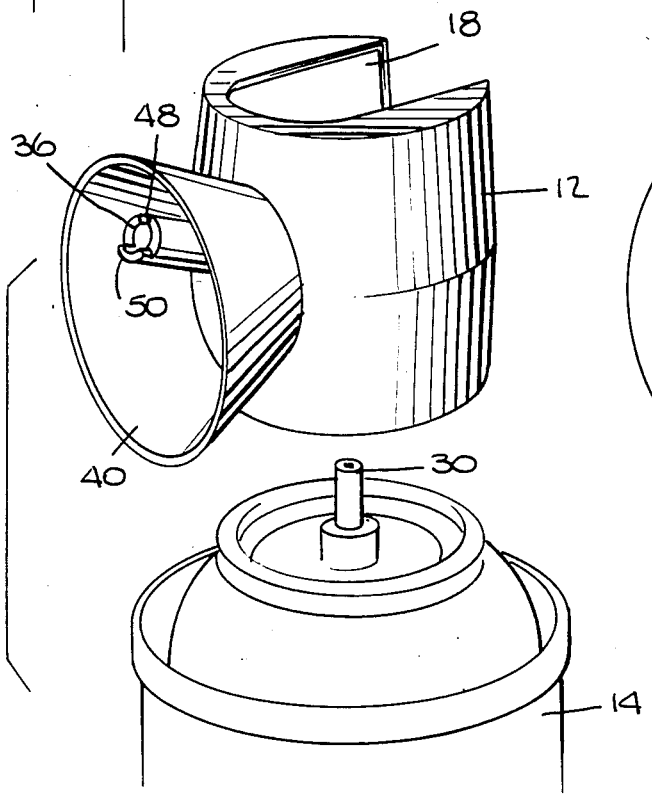
FIGS. 3A–3D are views of the overcap with which the nozzle device is used.
Figure 3B:
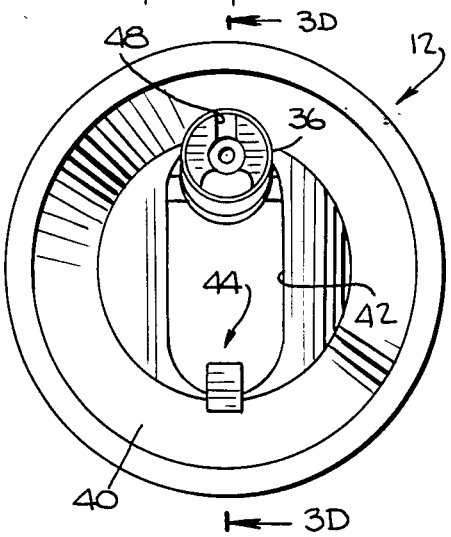
Figure 3C:
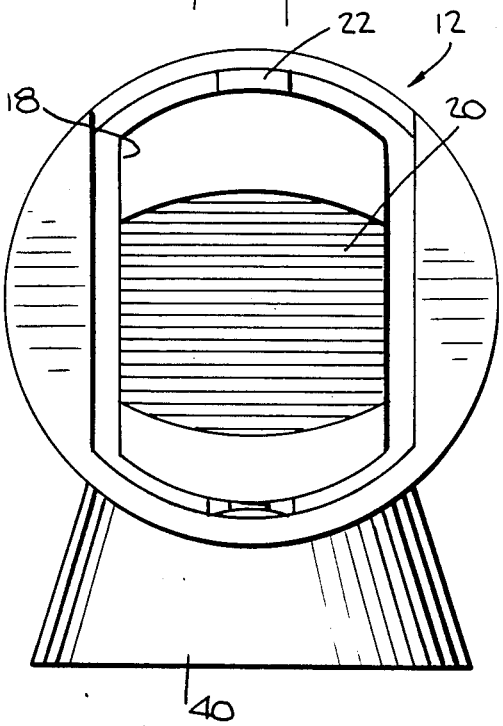
Figure 3D:
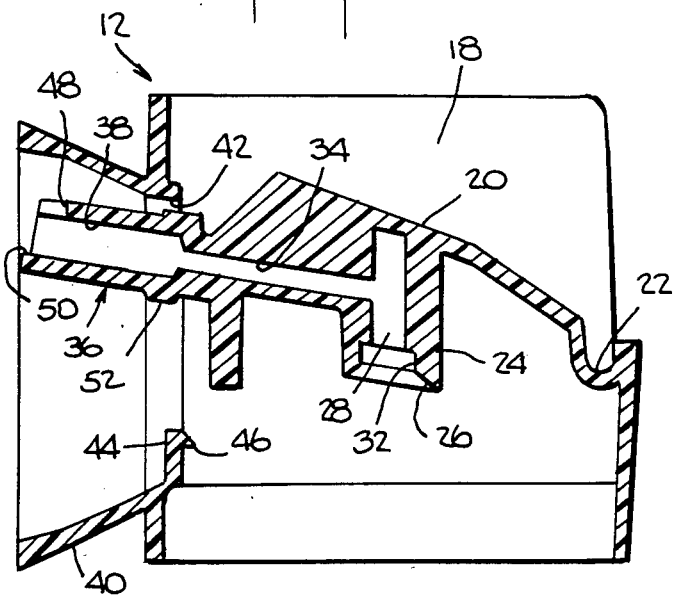

In the preferred embodiment, shown in FIGS. 1A and 1B, the overcap assembly 10 comprises an overcap 12 (sometimes referred to herein as an "actuator unit")

for mounting on a can 14 with which it is to be used, and a separate nozzle device 16, which in this embodiment is constructed as a separate component detachable from the overcap or actuator unit 12. The overcap 12 has a roughly cylindrical wall which is attached to the top of the can 14 (see FIG. 3A) by known means. A large recess 18 is provided in the top of the overcap 12 and in the back wall of the cylindrical surface, and has therein a button 20 hinged at 22 to the back surface of the overcap 12 to act as an actuator for dispensing the can contents, as described below. (Herein, "back" refers to the portion of the overcap assembly which generally faces the user for operation, and "front" refers to the side from which the product issues. Also, "bottom" and "lower" refer to the portion nearest the can 14, and "top" and "upper" to the opposite portion.) The connection is a hinge 22 with resilience (see FIGS. 3C and 3D), and is preferably made as a piece of plastic integral and continuous with the cylindrical wall of the overcap 12 and the button 20, and may preferably be injection molded. Depression of the button 20, as shown in FIGS. 1A and 1B, results in the product contained in can 14 being dispensed through the overcap assembly of the invention, as a spray in FIG. 1A and as a fog in FIG. 1B.

On the undersurface of the button 20 is a projection 24 which, in the embodiment shown, is cylindrical but could be of any other shape that does not interfere unacceptably with the manufacture or operation of the overcap assembly. The lower surface of projection is beveled at 26 and provided with a bore 28. The beveled undersurface 26 of projection 24 fits over a pressure valve 30 provided in can 14 when the overcap 12 is in place on the container. In this embodiment, the bore 28 has a widened portion 32, rimmed by the beveled area 26, to receive the cylindrical top of the pressure valve 30. Depression of the button 20 causes the widened bore 32 of the projection 24 to press down on the valve 30, for the purpose of opening the latter and releasing the container's contents upward into the bore 28.

The bore 28 communicates with a second, smaller bore 34 provided in the button 20. Bore 34 extends generally transversely from bore 28 to an outlet portion 36 which is shown as being integral and continuous with the free end of the button 20 and may preferably be injection molded as one piece therewith. The outlet portion 36 is generally cylindrical, and has an axial bore 38 one end of which communicates with the transverse bore 34 formed in the underside of the button 20. Thus, depression of the button 20 causes release of the can contents into bore 28, through bore 34 and out through the outlet portion 36. The front of the overcap 12 (see FIG. 3B) is provided with an outwardly flared horn 40, which is preferably integral with the cylindrical overcap wall from which it projects. The portion of the latter wall within the horn 40 is provided with an oval opening 42, through which the outlet portion 36 projects in this embodiment. Depression of the button 20 causes the outlet portion 36 to descend within the oval opening 42, and release of the button 20 allows the spring loaded pressure valve 30 to raise the button 20 and the outlet portion 36 to their original positions. In addition, the lower end of the oval opening 42 is provided with an upward-projecting flange 44 whose inner surface is provided with a lip or bead 46. This serves as a locking device for the nozzle insert 16 as is described below.

The upper surface of the outlet portion 36 has a notch or cutout 48 at the free end of portion 36, and a small protruding lip 50 on the lower surface. As can be seen with particular clarity in FIG. 3B, the projection 50 on the lower outer edge of the outlet portion 36 is preferably generally kidney-shaped. The end of the outlet portion 36 nearer the button 20 has an external collar 52. These features are for purposes to be described below.

The nozzle device 16 is roughly L-shaped in the embodiment illustrated (FIG. 2A), and includes a cylindrical body 54 and an arm 56 extending generally transversely from one end of the body 54. In the embodiment illustrated, the angle between the body 54 and arm 56 is approximately 98°, although this is by no means believed to be critical to the practice of the invention.

Figure 4A:
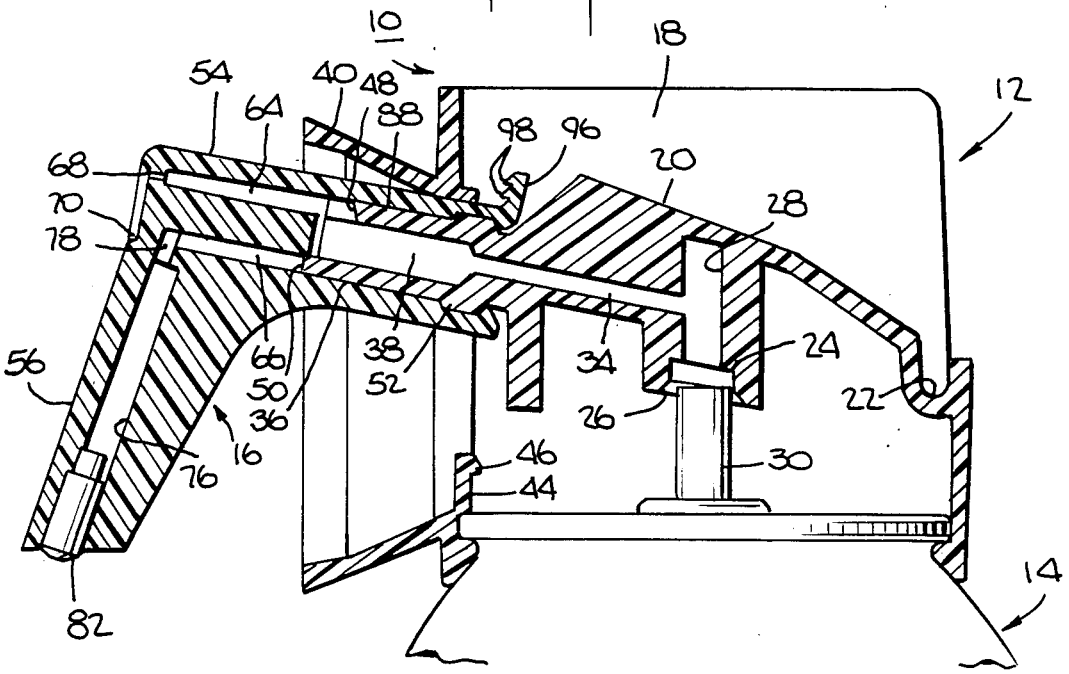
FIGS. 4A and 4B are cross sectional views of the overcap assembly with the nozzle device in place to produce a spray, FIG. 4A showing the assembly in the non-actuated position, and FIG. 4B showing the assembly in use to produce a spray.
Figure 4B:
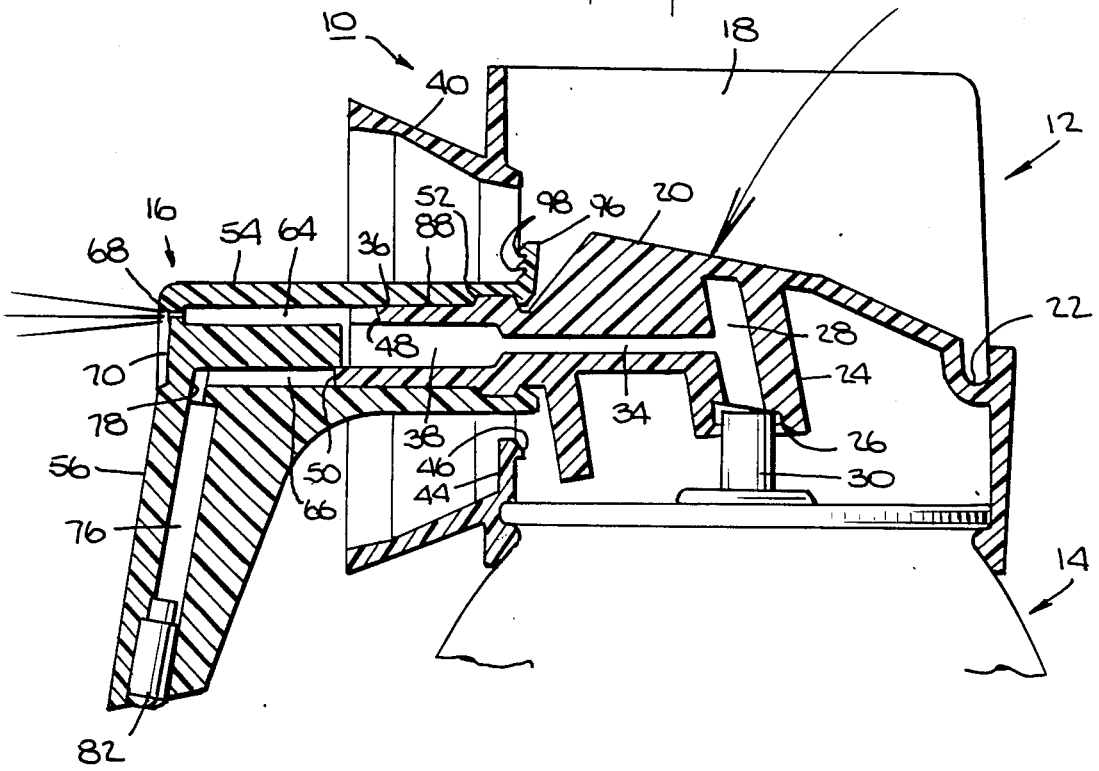

The cylindrical body 54 is hollow and is open at the end remote from that to which the arm 56 is attached. The rim of the open end is beveled at 58, and the hollow interior of the body 54 has a portion 60 with widened diameter just inward from the beveling 58 and separated from the latter by a lip 62. The lip 62 and the widened portion 60 cooperate to engage and retain the collar 52 formed on the outlet portion 36 of the overcap 12 when the nozzle device 16 is placed over outlet portion 36 as shown in FIG. 4A. The beveled rim 58 acts as a lead on ramp to aid in the assembly of the nozzle device 16 and the over cap 12.

The other, "forward" end of the body 54 is formed with first or upper (as seen in FIG. 2E) and second or lower passages 64 and 66, each of which is preferably kidney-shaped in cross section, although this is not believed to be critical. The first of these two passages 64 extends nearly to the forward end of the body 54, and communicates via a thin passage 68 with the exterior. A shallow recess 70 is preferably provided in the forward end of the body 54, and the thin communicating passage 68 is formed in the recess 70. This channel or flow-path serves as the outlet for product when the nozzle device 16 is in place on the overcap 12 and a spray output is desired. The direction of the spray is substantially (±20°) horizontal with respect to the axis of the aerosol container.

Figure 5A:
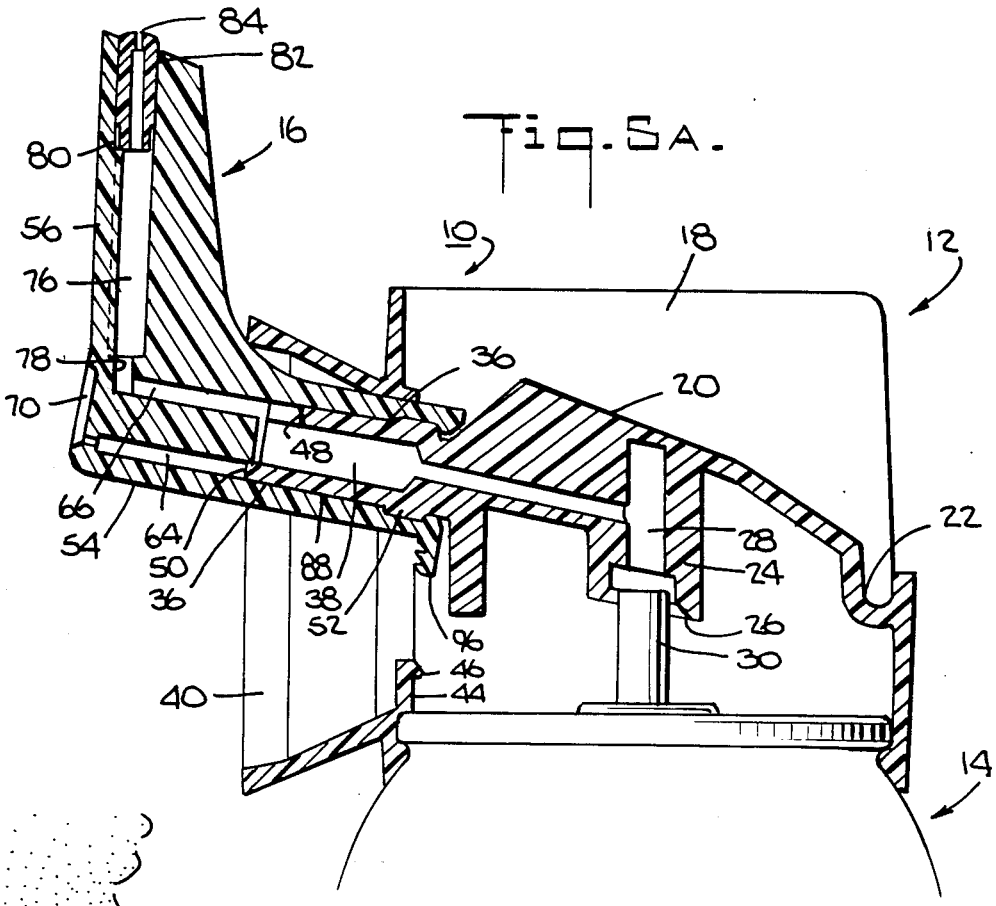
FIGS. 5A and 5B are cross sectional views of the overcap assembly with the nozzle device in place to produce a fog, FIG. 5A showing the assembly in the position it has when not actuated, and FIG. 5B showing the assembly in use to produce a fog.
Figure 5B:
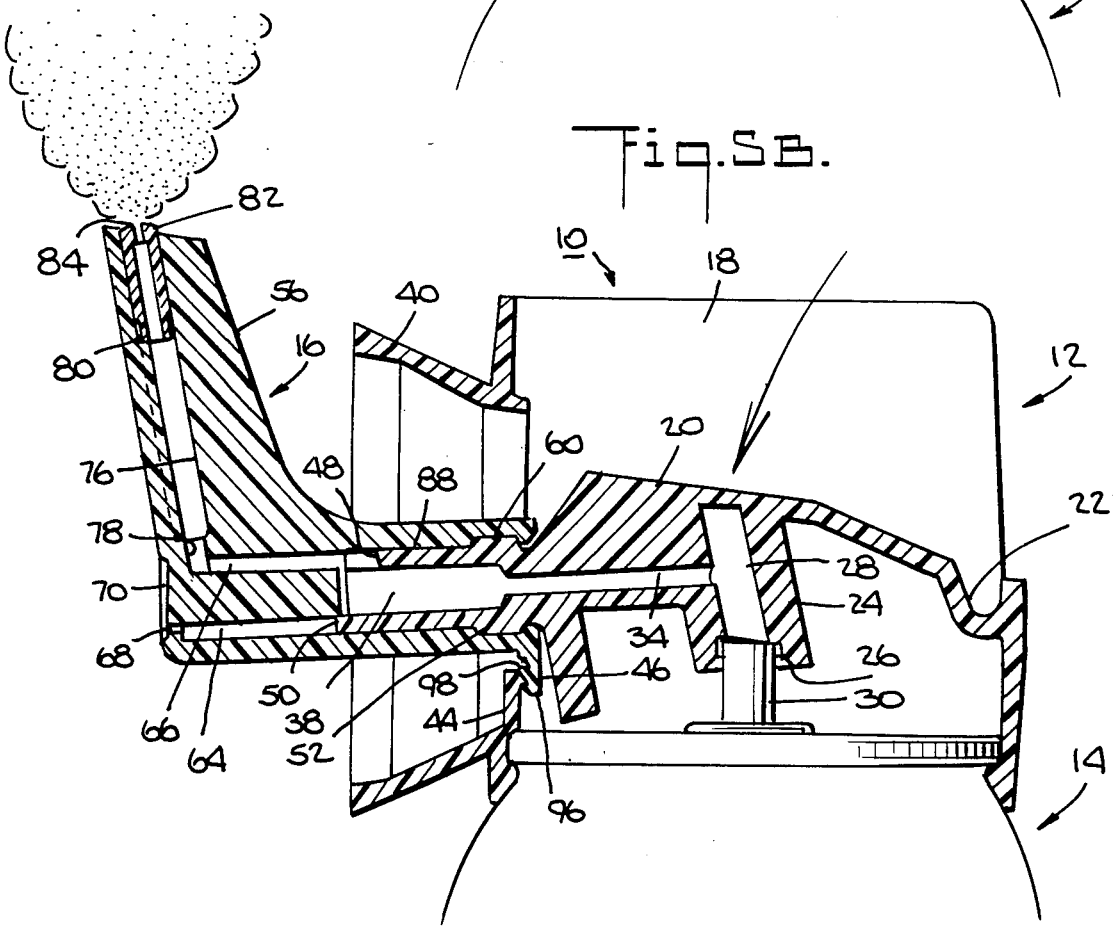

Both bores or passages 64 and 66, as mentioned, are preferably kidney-shaped in cross section and in any event are of a similar cross sectional size and shape at their back ends 72 and 74 as the projection or lip 50 on the lower free edge of the outlet portion 36. Moreover, the distance from the collar 52 to the edge of the lip 50 on the outlet portion 36 is slightly longer than the distance from the widened portion 60 of the interior of the body 54 of the nozzle device 16 to the back end 72, 74 of each of the two passages 64 and 66. As a result, the lip 50 on the outlet portion 36 lip covers and fits into the back or upstream opening of the passage 64 (see FIG. 4A). Since the nozzle outsert is freely rotatable about the outlet portion 36 when in place thereover due to the radial symmetry of the large bore 88 formed in the nozzle body 54 and the outlet portion 36 of the overcap 12, it is possible to rotate the nozzle device 16 between a position in which the spray passage 64 is blocked (see FIGS. 5A and 5B) and another position in which the second passage 66 is blocked and the spray passage 64 is open to receive product from the can 14 via the overcap 12 when the button 20 opens the pressure valve 30. A radial seal is created by an interference fit between large bore 88 and the outlet portion 36 which prevents the product from backflowing through the open end of nozzle body 54. The notch 48 which is cutout of the upper surface of the outlet portion 36 communicates with the axial bore 38 and the open passage 64 to complete the flow path to the exit orifice 68.

The second passage 66 in the body 54 of the nozzle device 16 intersects a bore 76 provided in the arm 56 of the nozzle device 16. In the preferred embodiment, the cylindrical bore 76 terminates approximately at the root of the arm 56, and has an extension 78 of smaller diameter which passes into the body 54. Along one wall of bore 76 is an oblong block 80, which is preferably integral with the material of the arm 56. This block 80 serves as a stop for an orifice-reducing body 82 which is preferably manufactured separately and placed in the orifice of the bore 76 to provide an aperture 84 of suitably small diameter for producing a fog. The orifice reducer 82 is illustrated in FIGS. 2F and 2G. As can be seen, the orifice reducer 82 has the same cross sectional shape as the bore 76 (cylindrical in this embodiment), and has a reduced outer diameter at one end 86. Formed in end 86 is a first, relatively large-diameter bore 90, while the other end has a smaller diameter bore which serves as the actual fog-producing aperture. The latter end of the orifice reducer 82 has a beveled or, preferably, spherical surface 92 around the aperture 84. In the embodiment illustrated, the juncture between the larger and smaller diameter portions of the outer wall of the orifice reducer 82 is also beveled, at 94. The orifice reducer 82 is placed manually or otherwise in the free end of the bore 76 of the arm 56, until it abuts the block 80. The axis of bore 76 is substantially (±20°) vertical with respect to the axis of passage 64.

The back end of the body 54 of the nozzle device 16 has a depending flange 96 provided on its forward surface with one or more teeth 98 (two in the illustrated embodiment). When the nozzle device 16 is placed over the outlet portion 36 of the overcap 12, in a position in which the arm 56 extends upward and the flange 96 of the nozzle device 16 extends downward, one of the teeth 98 on flange 96 engages and locks with the lip 46 on the inner surface of the upstanding flange 44 (see FIG. 5B), upon operation of the button 20, thus holding the pressure valve 30 of the container 14 in the open position. This ensures that when the button 20 is depressed with the nozzle device 16 in this position, the entire contents of the container 14 will be dispensed while the container is unattended by the operator. It should also be noted that because of the construction of flange 96 and lip 46, the mere moving of the nozzle device 16 to the fog position does not actuate the container until button 20 is depressed. This prevents accidental actuation which is a problem with other total release systems. Also in the event of accidental actuation, rotation of nozzle device 16 to the spray position will disengage the locking mechanism and stop the dispensing of the contents of the container 14.

In the illustrated embodiment, the arm 56 is shaped somewhat like a fin, roughly tear-drop shaped in cross section, the size of its cross section increasing from the free end 100 of the arm 56 to the root thereof where the arm 56 joins the body 54. The bore 76 is formed in the thickest part of the arm 56, which is at the forward part thereof. The shape of arm 56 is designed to act as a lever to aid in rotating nozzle 16 about outlet portion 36. The lateral surfaces of the arm 56 toward the back part thereof are provided with parallel grooves 102 which have a decorative effect, strengthen the arm 56, and reduce the amount of material required for the nozzle device 16, especially in the case that the nozzle device 16 is injection molded. This mode of manufacture provides an economical and effective part reliably and with little wastage.

While the present invention has been described in detail in connection with the preferred embodiment thereof, many modifications and variations thereof will now be apparent to those skilled in the art. Accordingly, the scope of the present invention is to be limited, not by the details of the embodiment illustratively described herein, but only by the terms of the appended claims.

What is claimed is:

1. An overcap assembly, comprising an actuator unit and a nozzle device, said actuator unit having means defining an outlet passage and having an acutator adapted for opening a valve of a container having contents under pressure to release the contents into said outlet passage, said nozzle device having a first outlet adapted to produce a spray of a material passing therethrough and a second outlet adapted to produce a for of a material passing therethrough, the axis of said second outlet being substantially transverse with respect to the axis of said first outlet, said nozzle device being connected to said actuator unit to selectively permit one or the other of said outlets to be in communication with said outlet passage of said actuator unit, wherein said nozzle device is movable, while connected to said actuator unit, between first and second positions relative to said actuator unit, said first and said second outlets respectively being in communication with said outlet passage when said nozzle device is in said first and said second positions, respectively, wherein said nozzle device and said actuator unit each have a respective cooperating locking member means for locking said actuator in a position to maintain open the valve of the container with which said assembly is being used, said locking member means being shaped and positioned so as to engage each other and lock upon operation of said actuator when said nozzle device is in said second relative position, and said locking member means being shaped and positioned so as to remain disengaged from each other when said nozzle device is in said first relative position, whereby actuation of the valve by said actuator will selectively produce a spray or a fog of the contents of the container.

2. The assembly of claim 1, wherein said nozzle device is structured to be rotatable relative to said actuator unit between said first and said second relative positions.

3. The assembly of claim 2, wherein said nozzle device comprises an injection-molded piece having said first outlet formed therein and has a bore formed therein, and also comprises an orifice-reducing insert received in said bore, said orifice-reducing insert having an aperture therein which serves as said second outlet.

4. The assembly of claim 1, wherein said means defining said outlet passage includes a blocking member and said nozzle device has first and second passages communicating with said first and second outlets, respectively, and wherein said blocking member blocks said first passage when said nozzle device is in said second relative position and blocks said second passage when said nozzle device is in said first relative position.

* * * * *

UNITED STATES PATENT AND TRADEMARK OFFICE

CERTIFICATE OF CORRECTION

PATENT NO. : 4,690,312

DATED : September 1, 1987

INVENTOR(S) : James R. Crapser
Scott W. Demarest

It is certified that error appears in the above-identified patent and that said Letters Patent is hereby corrected as shown below:

Column 6, line 20, - delete the word "for" and insert, therefore, the word "fog".

Signed and Sealed this

Fourth Day of October, 1988

*Attest:*

DONALD J. QUIGG

*Attesting Officer*

*Commissioner of Patents and Trademarks*